United States Patent [19]

Sullivan

[11] 4,313,602

[45] Feb. 2, 1982

[54] CYCLE-TYPE EXERCISER

[75] Inventor: James P. Sullivan, Tustin, Calif.

[73] Assignee: Marcy Gymnasium Equipment Co., Alhambra, Calif.

[21] Appl. No.: 118,756

[22] Filed: Feb. 5, 1980

[51] Int. Cl.[3] ..... A63B 21/00

[52] U.S. Cl. ..... 272/73; 272/132

[58] Field of Search ..... 272/73, 132, DIG. 3

[56] References Cited

FOREIGN PATENT DOCUMENTS 1961488 7/1970 Fed. Rep. of Germany ..... 273/73

2347062 11/1971 Fed. Rep. of Germany ..... 273/73

*Primary Examiner*—Richard C. Pinkham

*Assistant Examiner*—T. Brown

*Attorney, Agent, or Firm*—James E. Brunton

[57] ABSTRACT

An exercise device adapted to simulate the riding of a bicycle comprising a supporting frame, handlebars, a seat, a front wheel and pedal cranks engageable by the trainee to impart rotational movement to the front wheel. The degree of impedance to rotation of the front wheel can readily be adjusted by the trainee during performance of the exercise. The device also includes a unique impedance indicating feature which dynamically indicates to the trainee the degree of resistance against rotation of the front wheel which is being experienced at any given time.

4 Claims, 6 Drawing Figures

20a
20
2
36
34
28
30
4
92
86
16
4
44
46
60
76
90
88
42
72
38
14
12
40
24
2
18
22
26
26a

CYCLE-TYPE EXERCISER

BACKGROUND OF THE INVENTION

1. Field of the Invention

The present invention relates in general to a device for human physical conditioning. More particularly the device pertains to a compact cycle-type exerciser having unique variable resistance features.

2. Discussion of the Prior Art

During the last few years great emphasis has been placed upon physical fitness and the value of exercise as a means of maintaining good health is now widely recognized. Accordingly, there has been an ever increasing interest on the part of the public in such activities as jogging, walking and bicycling. In many parts of the country, however, inclement weather during substantial portions of the year prevents outside activities such as jogging and bicycling. Also many people living in cities do not have ready access to suitable outdoor exercise areas. These facts have created a real need for compact, easily portable exercise devices which can be set up and used in homes and offices.

Many physical fitness experts have recommended bicycling for developing muscular strength, endurance, wind and cardiovascular fitness. The device of the present invention provides all the benefits of bicycling, but enables the exercise to be performed within the trainee's home or office.

Various types of stationary exercycle devices have been suggested in the past. Many of these devices comprise little more than a standard bicycle, the rear or driving wheel of which is elevated from the floor. In other prior art devices the wheels and chain drives have been eliminated entirely and provide only a frame, handle bars and pedals. With such devices springs and hydraulic arrangements are sometimes suggested as means for providing resistance to the movement of the pedals. The patent to B. D. Parsons, U.S. Pat. No. 3,494,616 typifies a device of this character. Applicant is also familiar with a device manufactured by Tunturipyora-Oy of Turku, Finland which device represents the most pertinent art known to applicant.

SUMMARY OF THE INVENTION

The device of the present invention retains many of the characteristics of the standard bicycle and in use closely simulates actual bicycle riding. This is believed psychologically important to encourage a program of regular exercise. More particularly the exercycle disclosed herein includes a cycle-type frame with a seat, handle bars and pedals located in approximately the same proximity as would be found in a standard bicycle. The pedals are drivably connected to a standard bicycle wheel disposed at the front of the frame. When the trainee operates the pedals, the front wheel of the device will rotate against a variable resistance, the degree of which can be regulated by the trainee. An important feature of the invention resides in the means by which the resistance is regulated and the unique means for dynamically indicating to the trainee the degree of resistance against which he is exercising.

One object of the present invention is to provide an excerise device of the character described in the preceeding paragraphs which psychologically simulates actual bicycle riding conditions.

Another object of the invention is to provide simple means whereby the trainee can readily and precisely vary the amount of resistance offered against movement of the pedals.

Another object of the invention is to provide means for varying the resistance to rotation of the pedals which means is operable without the necessity of stopping the exercise.

A further object of the invention is to provide a device as described in the previous paragraphs in which the degree of resistance being experienced by the trainee is dynamically registered on a resistance indicator visible to the trainee during performance of the exercise.

It is another object of the invention to provide an exercise device of the class described which is readily portable and can be easily stored when not in use, which is adjustable for use by trainees of various sizes and which is safe, stable and durable in use.

DESCRIPTION OF ONE EMBODIMENT OF THE INVENTION

Figure 1:
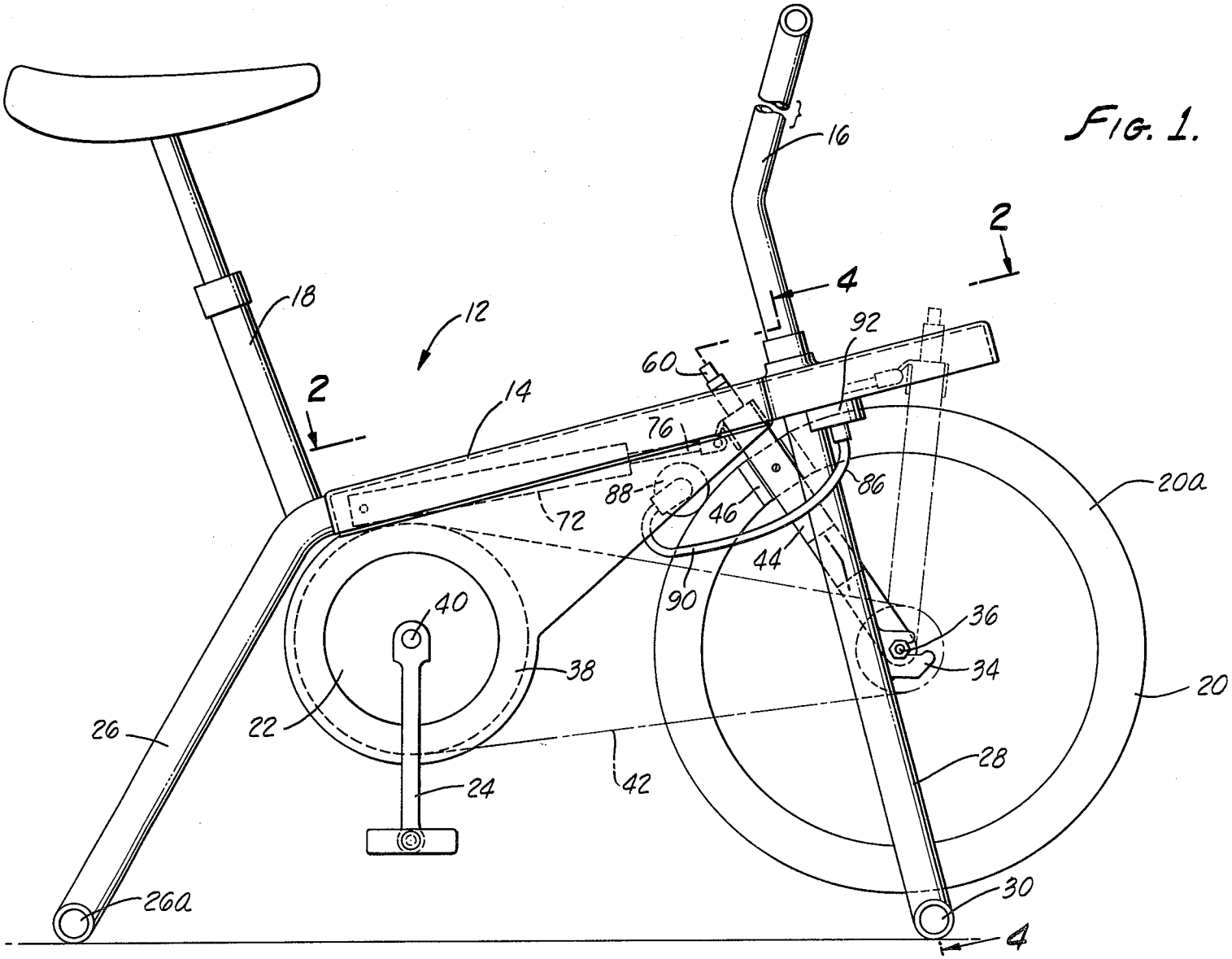
FIG. 1 is a side elevational view of the exercise device of the present invention.
Figure 4:
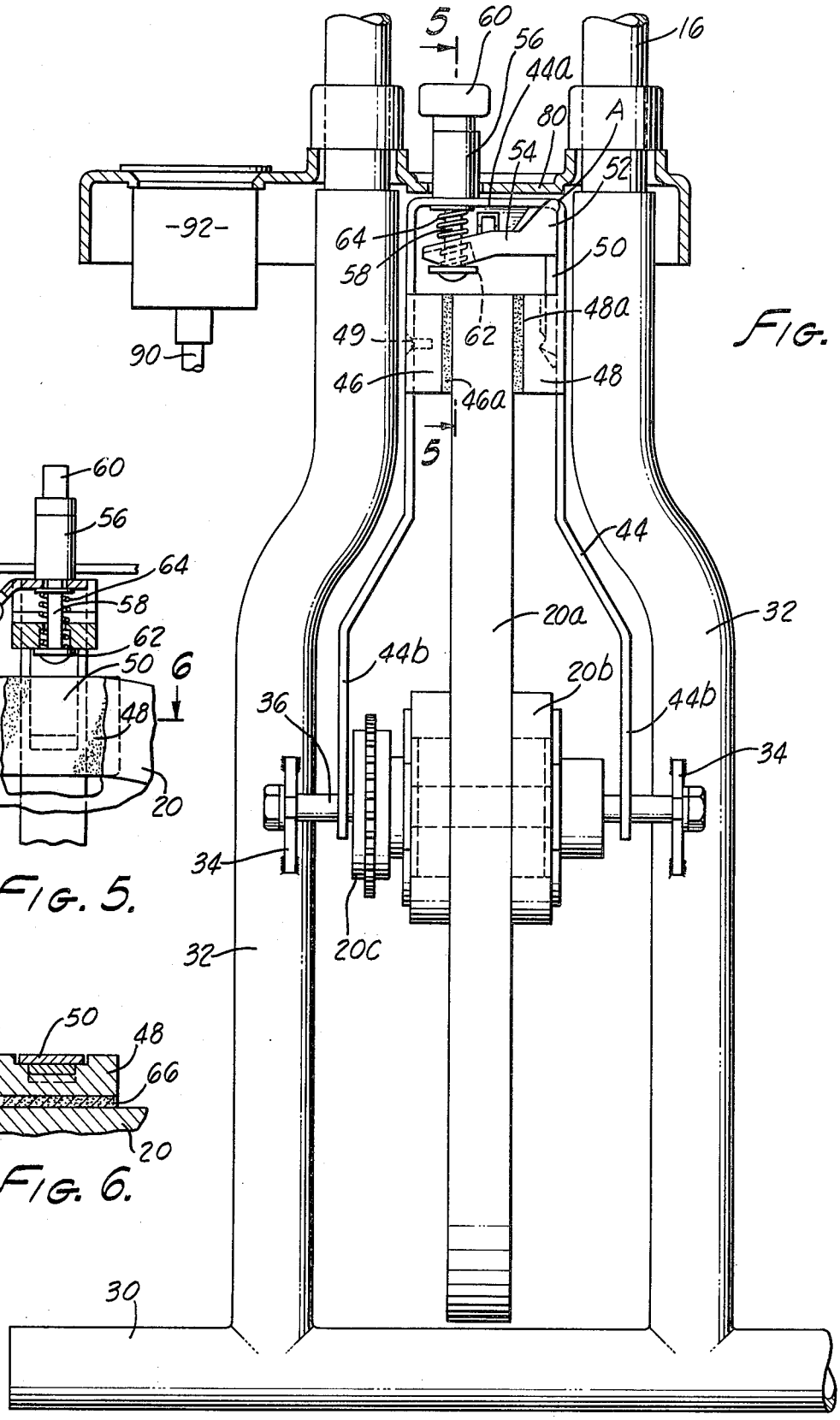
FIG. 4 is a greatly enlarged fragmentary end view taken along lines 4—4 of FIG. 1.

Referring to the drawings, and particularly to FIGS. 1 and 4, one form of the exercise device of the present invention adapted for use by a trainee to simulate the riding of a bicycle is generally designated by the numeral 12. The device comprises a supporting frame 14 adapted to maintain the device in an upright position, handle bars 16 connected to frame 14, a seat assembly 18 attached to frame 14 in a rearwardly spaced relation to handle bars 16, a front wheel assembly 20 rotatably carried by the frame and a pedal assembly 22, including pedal cranks 24, operably interconnected with wheel assembly 20 to impart rotational forces thereto. The device further includes novel resistance imparting and indicating means for imparting variable resistance against rotation of wheel **20*a*** of the wheel assembly and, at the same time, dynamically indicating to the trainee the degree of resistance against rotation of the wheel which he is experiencing at any given time. The details of construction of this unique means will presently be discussed.

To provide stability to the device, supporting frame 14 includes a rearwardly disposed, downwardly depending support member 26 having a base portion **26*a* and a forwardly disposed support member 28. Member 28 comprises a ground engaging base member 30 and a pair of spaced apart downwardly depending fork-like members 32 (FIG. 4**).

Rotatably supported between a pair of forwardly extending brackets 34 affixed to members 32 is an axle member 36 which carries the wheel assembly 20. As shown in FIG. 4, wheel assembly 20 includes, in addition to wheel **20*a*, a hub assembly 20*b* which is rotatably carried by axle 36 so that wheel 20*a* may freely rotate between fork-like members 32 and a drive hub 20***c* which is drivably connected to the hub assembly 20*b*.

Referring again to FIG. 1, the pedal assembly of the device comprises a sprocket, or drive wheel 38 affixed to a rotatable shaft 40 carried by frame 14. Pedal cranks 24 are connected to shaft 38 so that by pedaling the device much in the same manner as a conventional bicycle, shaft 38, and sprocket member 40 which is attached thereto, will be caused to rotate. The sprocket member is in turn operably interconnected with the drive hub 20*c* of the wheel assembly by any suitable drive means such as a chain or drive belt 42. In this way a pedaling action by the trainee will impart rotational forces to the wheel assembly 20. However, since the wheel 20*a* is freely rotatable within the forward support member, the device will remain stationary during the pedaling action.

Forming an important feature of the device of the present invention is the previously mentioned resistance imparting and indicating means for simultaneously imparting resistance to rotation of the wheel and indicating to the trainee the degree of resistance being experienced during performance of the exercise. Referring particularly to FIGS. 3 through 6, this unique means can be seen to comprise a friction means for imparting frictional impedance to rotation of wheel 20*a* and a biasing means generally designated by the numeral 43. The friction means is carried by axle 36 and is rotatable with respect thereto through a prescribed arc. The biasing means is carried by frame 14 for yieldably resisting rotation of the friction means throughout the prescribed arc.

Figure 5:
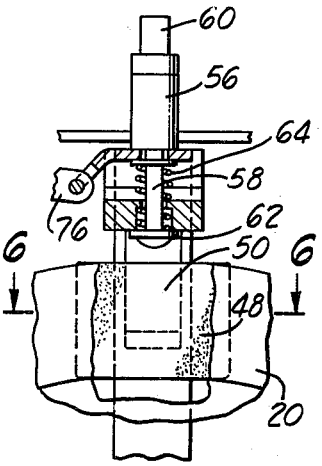
FIG. 5 is an enlarged fragmentary view, partly in cross-section taken along lines 5—5 of FIG. 4.
Figure 6:
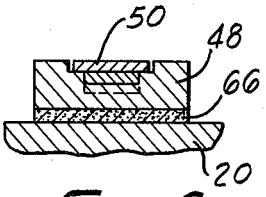
FIG. 6 is a cross-sectional view taken along lines 6—6 of FIG. 5.

As best seen in FIG. 4, the friction means of this form of the invention comprises a generally "U" shaped support frame 44 having a bight portion 44*a* and a pair of downwardly depending, spaced apart legs 44*b*. Legs 44*b* are adapted to straddle wheel 20 and are connected proximate their lower extremity to axle 36. Carried proximate the upper end of frame 44 is a pair of friction members 46 and 48. These friction members include replaceable friction pads 46*a* and 48*a* disposed in close proximity to the outer periphery of wheel 20*a*. These pads may be constructed of any suitable material having good frictional characteristics. As seen in FIG. 4, member 46 is fixedly connected to one of the legs of support bar 24 by a threaded fastener 49. The other friction member 48 is held in position proximate the wheel by the lower leg 50 of a generally "L" shaped lever members 52 which comprises a part of the lever means of the invention for controllably moving the movable friction member 48 into frictional engagement with wheel 20*a*. Connected adjacent the end of the second leg 54 of lever 52 is a unique combination indicating and control means for indicating the resistance experienced by the trainee against a calibration scale and for controlling the movement of member 48 relative to wheel 20*a*. In the form of the invention shown in the drawings, this control means comprises an internally threaded housing 56 carried by frame 44 and a cooperating downwardly extending rod 58, which is threadably receivable into housing 56. Provided at the upper end of rod 58 is an actuating knob 60 which is rotatable by the trainee to move the rod up or down relative to housing 56. As best seen in FIGS. 4 and 5, provided at the lower end of member 58 is an increased diameter portion 62 adapted to engage the lower surface of arm 54 of lever 52. Disposed intermediate portion 62 and knob 60 is a biasing means shown here in the form of a coiled spring 64 for yieldably resisting tightening rotation of knob 60.

In operation, clockwise rotation of knob 60 will cause upward movement of portion 62 against the urging of spring 64. This upward movement of portion 62 will urge pivotal movement of lever 52 within frame 44 about a point indicated in FIG. 4 by the letter A. This pivotal movement of lever 52 will cause lower leg 50 to urge lateral movement of member 48 in a direction toward wheel 20*a*. Continued lateral movement of member 48 will cause friction pad 48*a* to move into frictional engagement with wheel 20*a* so as to resist rotation of the wheel. At the same time, this lateral movement of pad 48 will force wheel 20*a* into engagement with friction pad 46*a* of fixed member 46 thereby increasing the frictional resistance being imparted against rotation of wheel 20*a*. Obviously, continued rotation of knob 60 resulting in upward forces being generated on leg 54 of lever 52 will tend to increase the amount of frictional resistance being imparted to wheel 20*a* which, of course, will in turn make movement of the pedals more difficult.

Figure 3:
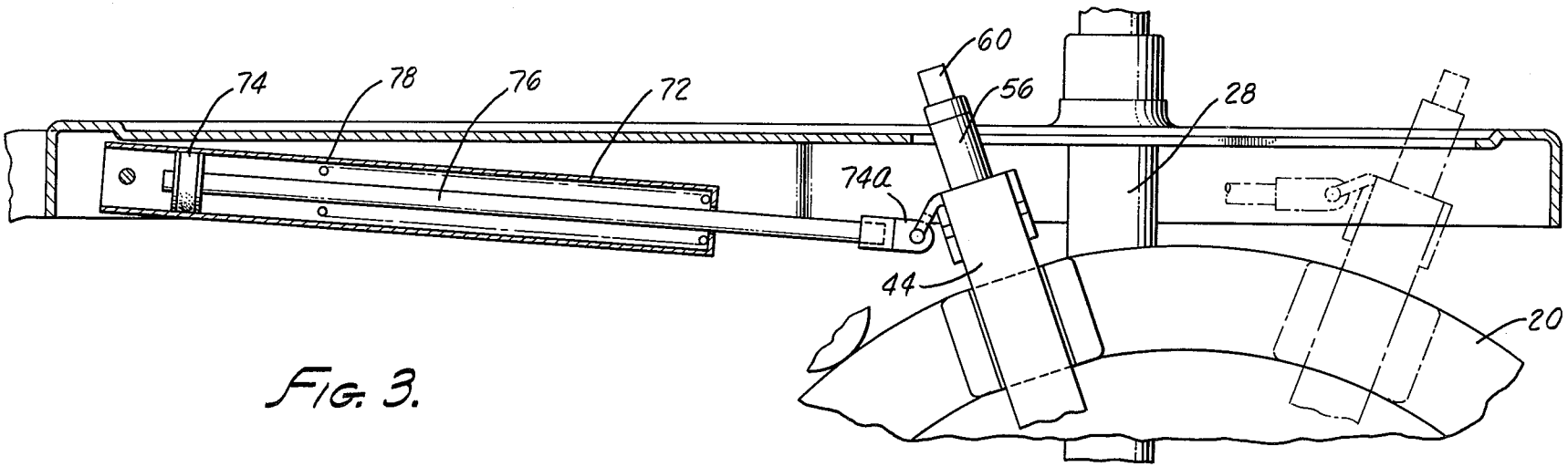
FIG. 3 is a fragmentary side elevational view, partially in cross-section taken along lines 3—3 of FIG. 2.

Turning now to FIG. 3, it will be observed that when the trainee exerts pressure on the pedal assembly so as to impart rotational forces to wheel 20*a*, the friction means just described will tend to move along an arcuate path from the position shown by the solid lines in FIG. 3 toward the position shown by the phantom lines of FIG. 3. Resisting this rotational movement of the friction means, however, is the biasing means of the invention. In the form of the invention shown in FIG. 3, this biasing means comprises an elongated cylindrical housing 72, a piston 74 closely receivable within housing 72 and a piston rod 76 having one end connected to piston 74 and the opposite end 74*a* pivotally connected by means of a suitable connector to a bracket provided at the upper end of frame 44. Carried within housing 72 are spring means for yieldably resisting the movement of piston 72 in a forward direction or toward frame 44.

OPERATION

In operating the device of the invention, the trainee first adjusts the seat and handle bars into a comfortable position. Next, by turning knob 60 in a clockwise direction the trainee can controllably impart a frictional resistance to rotation of the wheel 20*a*. The more the knob is turned the greater will be the resistance imparted to rotation of the wheel and the greater will be the effort required to operate the pedals.

Assuming that the control knob 60 is turned to an intermediate position, forces exerted on the pedals will cause rotation of wheel 20*a* in a clockwise direction. However, due to the frictional drag imparted by the friction pads to rotation of the wheel, the entire friction means including frame 44 will tend to pivot forwardly about axle 36 along an arcuate path toward the position shown by the phantom lines in FIG. 3. This forward movement of frame 44 will, in turn, cause rod 76 to which it is connected, along with piston 74 of the biasing means to move forwardly (to the right in FIG. 3) against the urging of spring 78 which, in this form of the invention, comprises the spring means of the device. At some point the frictional drag imparted by the friction members and the resistance offered by spring 78 will balance. At this point the friction means will stop moving to the right and, so long as the trainee continues to pedal at the same rate, will remain in a relatively constant position with respect to the frame 14 of the exercycle.

Figure 2:
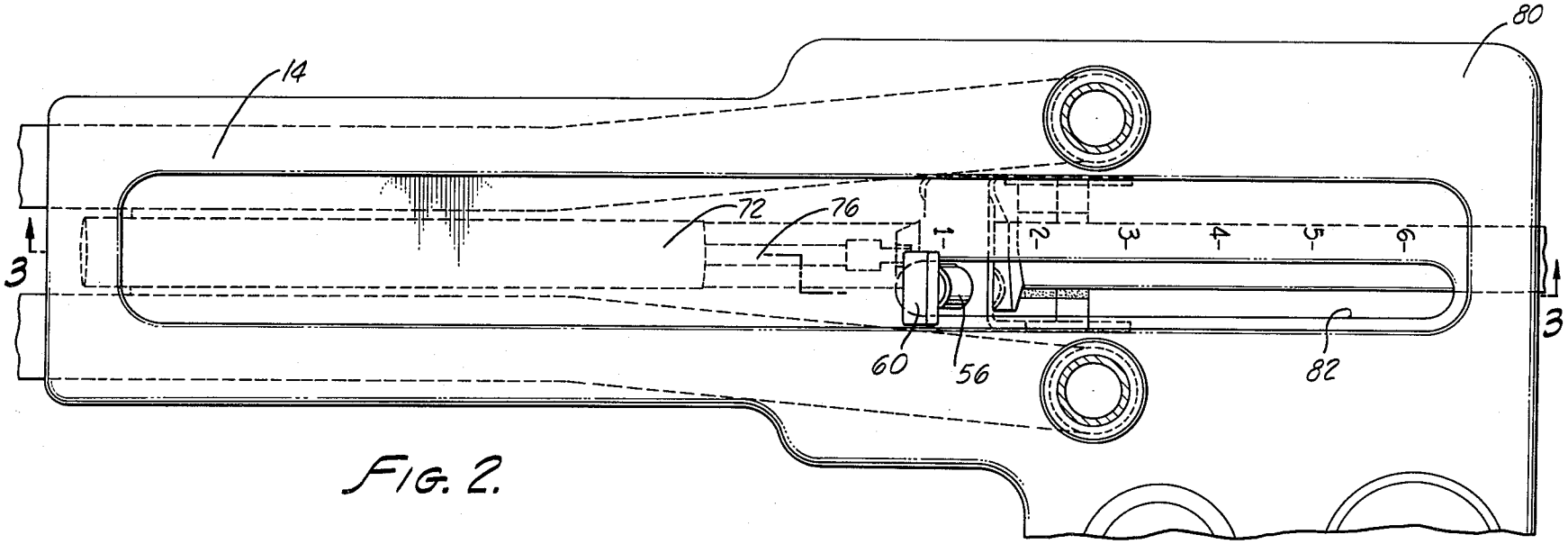
FIG. 2 is an enlarged fragmentary plan view taken along lines 2—2 of FIG. 1.

To enable the trainee to note, and later reproduce the resistance against which he is then working, the device of the invention includes display means for relating the position of the friction means with respect to a calibrated scale. As illustrated in FIG. 2 in this form of the invention, the display means comprises a dash plate 80 having an elongated slotted portion 82 adapted to receive housing 56 of the friction means and to permit the arcuate movement thereof from the position illustrated by the solid lines of FIG. 3 to the position illustrated by the phantom lines of FIG. 3. Dash plate 80, which is affixed to supporting frame 14, has engraved thereon the numbers 1 through 6 so that during the exercise, the trainee can note the position of the friction means relative to the dash plate and can "read" the amount of resistance being imparted to rotation of the front wheel. By tightening down on knob 60 so as to increase the resistance imparted to rotation of the wheel, it is obvious that the resistance means will move against the urging of spring 78 to a higher numbered position on the scale in a direction toward the forward extremity of the apparatus. With this unique combination indicating, control and display feature of the apparatus, the trainee can dynamically adjust the amount of resistance to rotation of the wheel which he desires for a given period of exercise. During subsequent periods of exercise, the trainee can readily adjust the resistance means so as to reproduce any particular resistance against which he wishes to train.

When the trainee stops the exercise, thereby removing the force which tends to urge the resistance means forwardly against the urging of spring 78, the resistance means will return to the at rest position shown by the solid lines in FIG. 3. In this regard, it is to be noted that the design of piston 74 is such that the piston will smoothly return to its at rest position without any chattering or interrupted movement. This is accomplished by constructing the piston from a soft felt-like material, a soft rubber, or a material such as teflon which will closely engage the walls of cylinder 72 and smoothly travel therealong as the friction means returns to an at rest position.

So that the trainee can further monitor his exercise, the apparatus of the invention also includes a speedometer device generally designated by the numeral 86 (FIG. 1). This speedometer device includes a follower wheel 88 which rolls against wheel 20*a* and translates its speed of rotation through a cable 90 to a speedometer unit 92 carried by the dash plate 80. This speedometer unit is of conventional design and forms no part of the present invention. The details of its construction, therefore, will not be discussed.

By noting the speed of rotation of the wheel and the degree of resistance being offered by the friction means, the trainee can effectively calibrate the severity of the exercise being performed. The severity of the exercise can then be gradually and controllably increased as the trainee's physical condition improves.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. An exercise device for use by a trainee to simulate riding of a bicycle, comprising:

(a) a supporting frame including a rearwardly disposed, downwardly depending support member and a forwardly disposed support member having downwardly depending spaced apart fork-like members;

(b) an axle carried by said fork-like members and extending therebetween;

(c) a wheel rotatably carried by said axle intermediate said fork-like members;

(d) handle bars attached to said frame;

(e) a seat attached to said frame in a rearwardly spaced relation to said handle bars;

(f) a rotatable shaft carried by said frame and operably interconnected with said wheel whereby rotation of said shaft will impart rotational forces to said wheel;

(g) pedal cranks attached to said shaft for rotation therewith said pedal cranks being engageable by the feet of the trainee to impart rotational movement to said shaft;

(h) resistance imparting and indicating means for imparting vehicle resistance against rotation of said wheel and simultaneously indicating to the trainee the degree of resistance against performance of the exercise which is being experienced said resistance imparting and indicating means comprising:

(1) friction means carried by said axle and rotatable with respect thereto throughout a prescribed arc, said friction means being adapted to controllably impede the rotation of said wheel, said friction means comprises:

(i) a generally "U" shaped frame having a bight portion and a pair of spaced apart legs adapted to straddle said wheel and being connected to said axle proximate their lower extremities;

(ii) a pair of friction members carried by said legs in close proximity to the outer periphery of said wheel, one of said friction members being stationarily attached to one leg of said U-shaped member and the other of said friction members being movable relative to said wheel;

(iii) lever means connected at said bight portion of said "U" shaped frame and adapted for moving said other friction member into engagement with said wheel;

(iv) control means operably associated with said lever means and operable by the trainee to cause movement of said lever means to controllably move said friction member into engagement with said wheel; and (2) biasing means carried by said supporting frame and operably interconnected with said friction means for yieldably resisting rotation of said friction means throughout said arc, said biasing means comprising:

(i) an elongated housing;

(ii) a piston closely receivable within said housing and reciprocally movable therewithin;

(iii) a piston rod having one end connected to said piston and the opposite end connected to said pad support bar; and (iv) spring means carried within said housing for yieldably resisting reciprocal movement of said piston;

(3) display means including display indicia for indicating to the trainee during use of the device the position of said control means within the arc of travel of said friction means.

2. In an exercise device for use by a trainee to simulate riding of a bicycle of the type characterized by having a supporting frame, handle bars attached to the frame, a seat attached to the frame in a rearwardly spaced relation to the handle bars, a wheel rotatably carried by the frame, a rotatable shaft carried by the frame and operably interconnected with the wheel whereby rotation of the shaft will impart rotational forces to the wheel and pedal cranks attached to the shaft for rotation therewith; the improvement comprising a resistance imparting mechanism which comprises a resistance imparting means carried by the supporting frame for imparting variable resistance to rotation of the wheel, said means comprising:

(a) friction means carried by the axle and rotatable with respect thereto throughout a prescribed arc for controllably impeding the rotation of said wheel; said friction means comprising:

(1) a generally "U" shaped frame having a bight portion and a pair of downwardly depending spaced apart legs adapted to be connected proximate their lower extremities to said axle;

(2) a first friction member carried by one of said legs in close proximity to the outer periphery of said wheel;

(3) a generally "L" shaped lever carried by said "U" shaped frame for pivotal movement with respect thereto, said lever having an upper and a lower leg portion;

(4) a second friction member carried by said lower leg portion of said lever; and (5) control means connected to said upper leg portion of said lever for moving said lower leg portion toward said wheel;

(b) biasing means carried by the frame and operably interconnected with said friction means for yieldably resisting rotation of said friction means; and (c) display means for indicating the position of the control means within said prescribed arc.

3. An exercise device as defined in claim 2 in which said control means comprises:

(a) an internally threaded housing carried by the supporting frame; and (b) a downwardly depending control rod having an upper portion threadably receivable in said housing and a lower portion adapted to be connected to said upper leg portion of said lever.

4. An exercise device as defined in claim 3 in which said control means further includes biasing means for yieldably resisting movement of said upper leg portion of said lever toward said housing.

* * * * *